United States Patent [19]

Shrock

[11] Patent Number: 4,543,675

[45] Date of Patent: Oct. 1, 1985

[54] VEHICLE SEAT-BED EXTENDER

[76] Inventor: Fred J. Shrock, 55068 Phillips, Elkhart, Ind. 46515

[21] Appl. No.: 577,334

[22] Filed: Feb. 6, 1984

[51] Int. Cl.[4] ..... A47C 17/04

[52] U.S. Cl. ..... 5/37 R; 5/37 C; 5/41; 5/18 R

[58] Field of Search ..... 5/12 R, 37 R, 37 B, 5/37 C, 38–42, 17, 47; 297/112, 114

[56] References Cited

U.S. PATENT DOCUMENTS 2,562,197 7/1951 Martin ..... 5/38
2,784,766 3/1957 Hale ..... 297/114
4,321,716 3/1982 Shrock ..... 5/37 R
4,343,508 8/1982 Heling et al. ..... 5/37 B

FOREIGN PATENT DOCUMENTS 192074 11/1956 Austria ..... 5/37 C

*Primary Examiner*—Gary L. Smith
*Assistant Examiner*—Michael F. Trettel
*Attorney, Agent, or Firm*—James D. Hall; Thomas J. Dodd

[57] ABSTRACT

An improved seat-bed assembly for a vehicle. The assembly includes seat, back and extender supports and corresponding linkage to allow conversion from seat form to a full-sized bed.

4 Claims, 5 Drawing Figures

VEHICLE SEAT-BED EXTENDER

SUMMARY OF THE INVENTION

This invention relates to a convertible seat-bed assembly, and will have specific application to an extender for converting the assembly into a full sized bed.

The seat-bed assembly of this invention is principally adapted for use in a vehicle such as a camper or van. Heretofore, seat-bed assemblies were convertible from a seating position into a fold-out twin or double sized bed. This type of construction is embodied in U.S. Pat. No. 4,321,716, incorporated herein by reference.

The seat-bed assembly of this invention utilizes an extender linked to the back support member, which when folded into the bed position, converts the seat into a full sized bed. The construction is lightweight, durable, and economical.

Accordingly, it is an object of this invention to provide for a novel convertible seat-bed assembly.

Another object of this invention is to provide a linkage system which is for a seat-bed assembly and which allows the seat to be converted into a full-sized bed.

Another object of this invention is to provide for a seat-bed assembly which is lightweight, durable and economical.

Still another object of this invention is to provide for a seat-bed assembly which is rapidly and easily converted from a seat to a full-sized bed.

Other objects of this invention will become apparent upon a reading of the following description.

BRIEF DESCRIPTION OF THE DRAWINGS

A preferred embodiment of the invention has been chosen to explain the principles thereof wherein.

DESCRIPTION OF THE PREFERRED EMBODIMENT

The preferred embodiment herein described is not intended to be exhaustive or to limit the application to the precise form disclosed. It is chosen and described to best explain the principles of the invention and its application and practical use to thereby enable others skilled in the art to utilize the invention.

Figure 1:
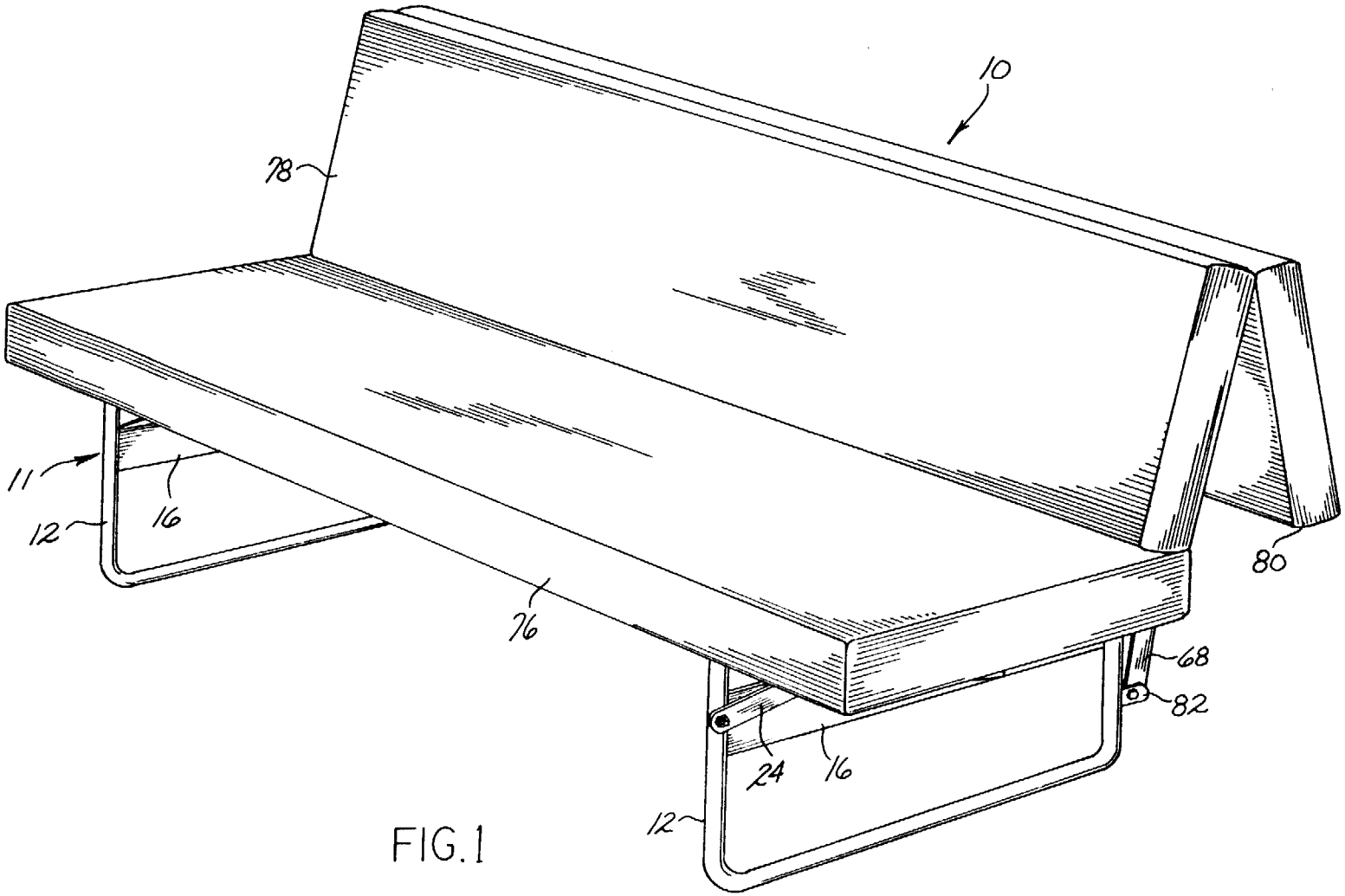
FIG. 1 is a perspective view of the seat-bed assembly in its seat position.
Figure 2:
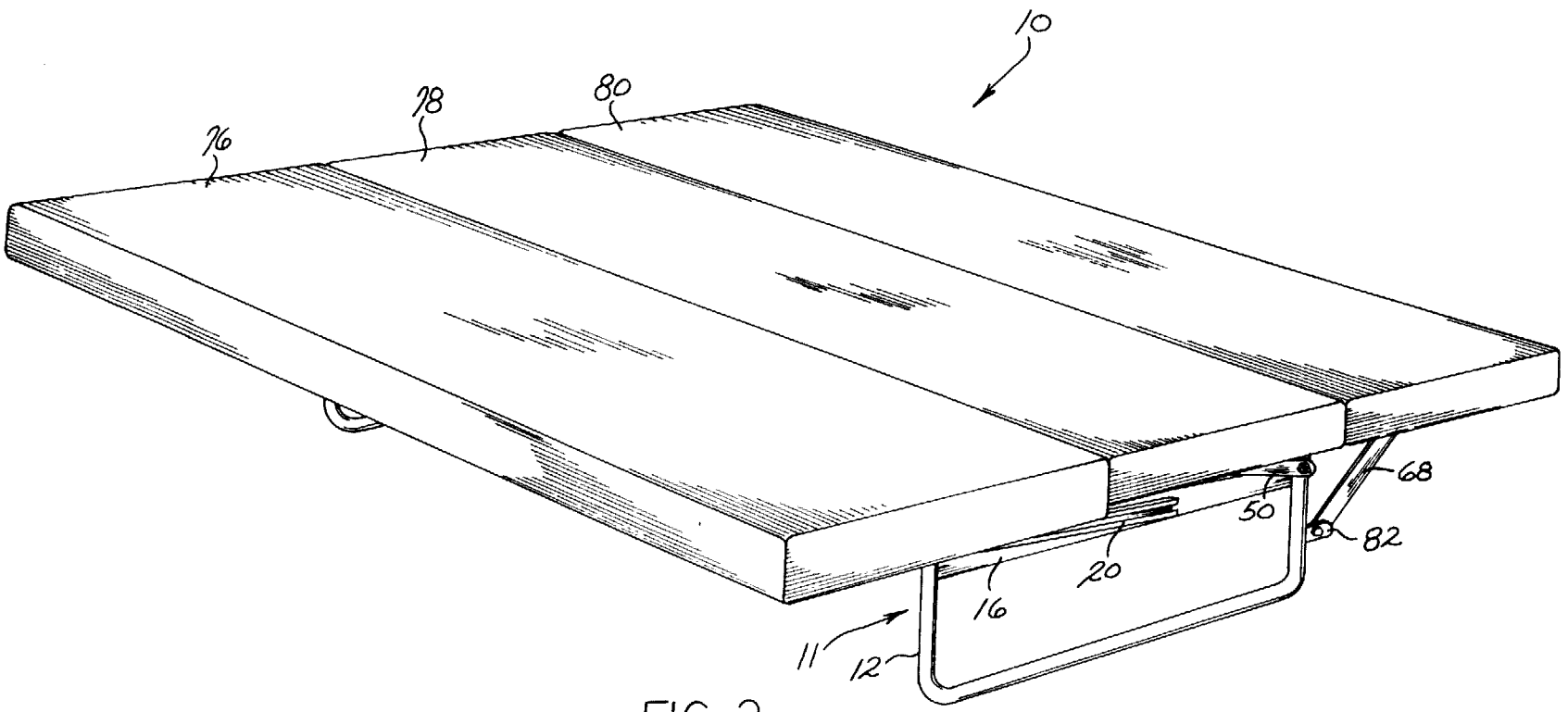
FIG. 2 is a perspective view of the seat-bed in its bed position.
Figure 3:
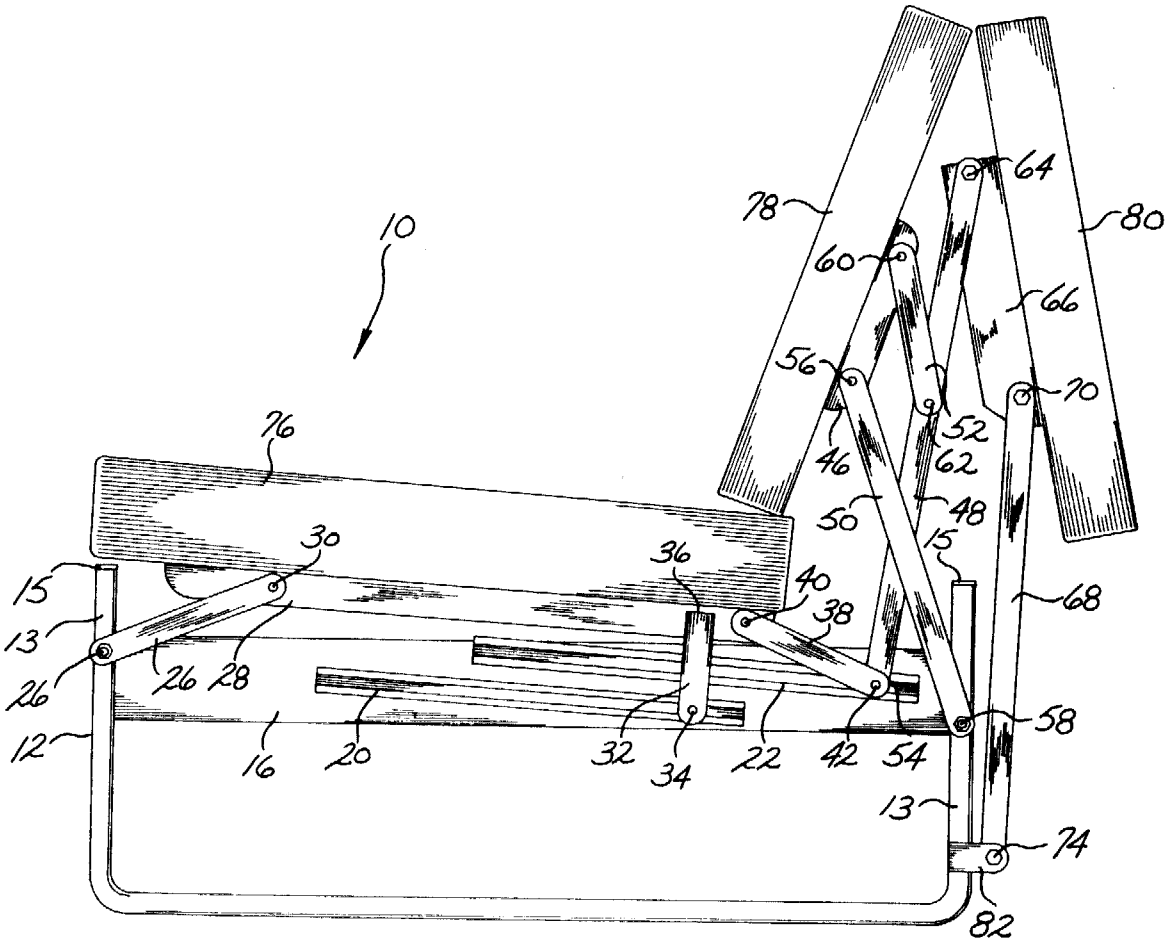
FIG. 3 is a side elevational view of the assembly in its seat position.
Figure 4:
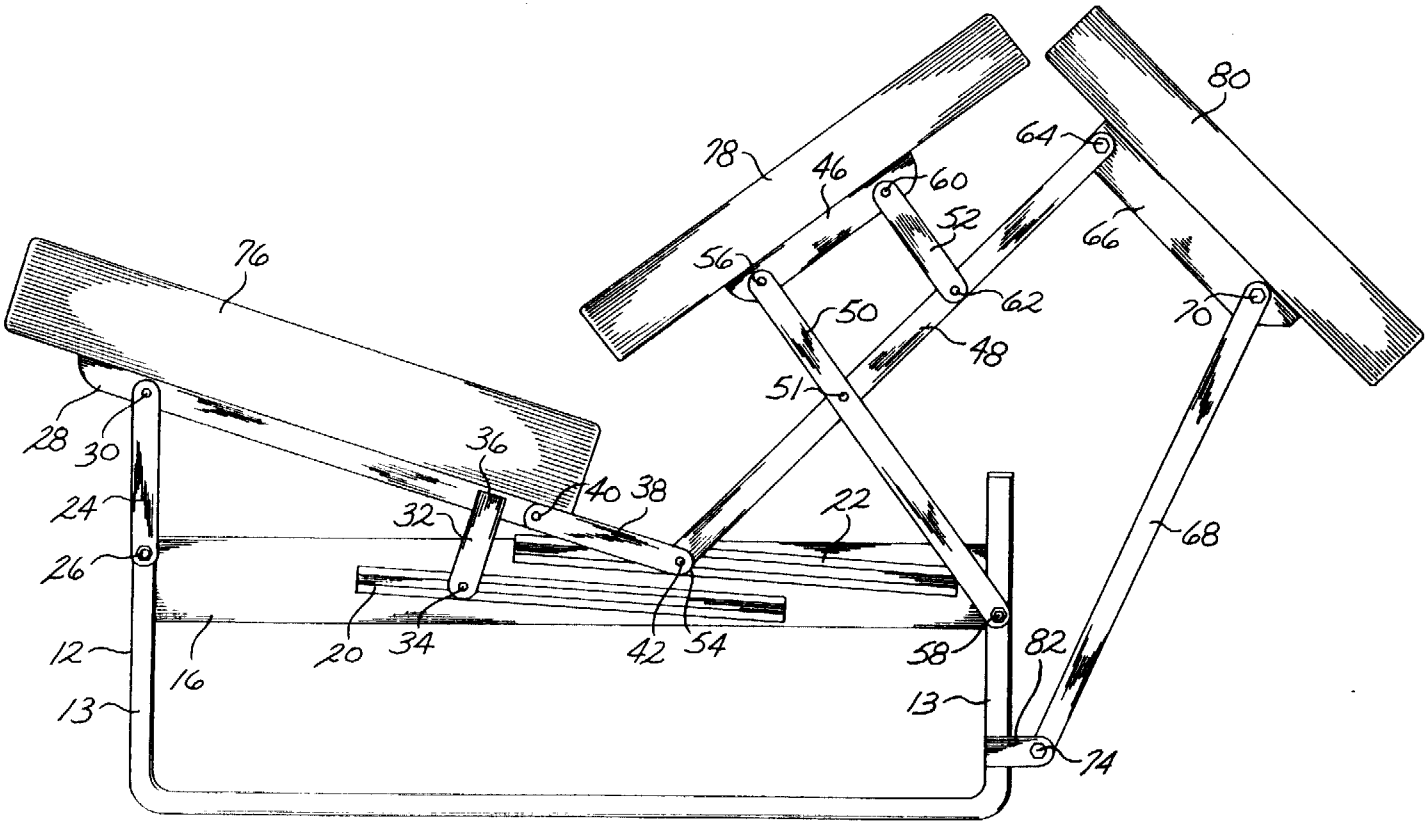
FIG. 4 is a side elevational view of the assembly in an intermediate position.
Figure 5:
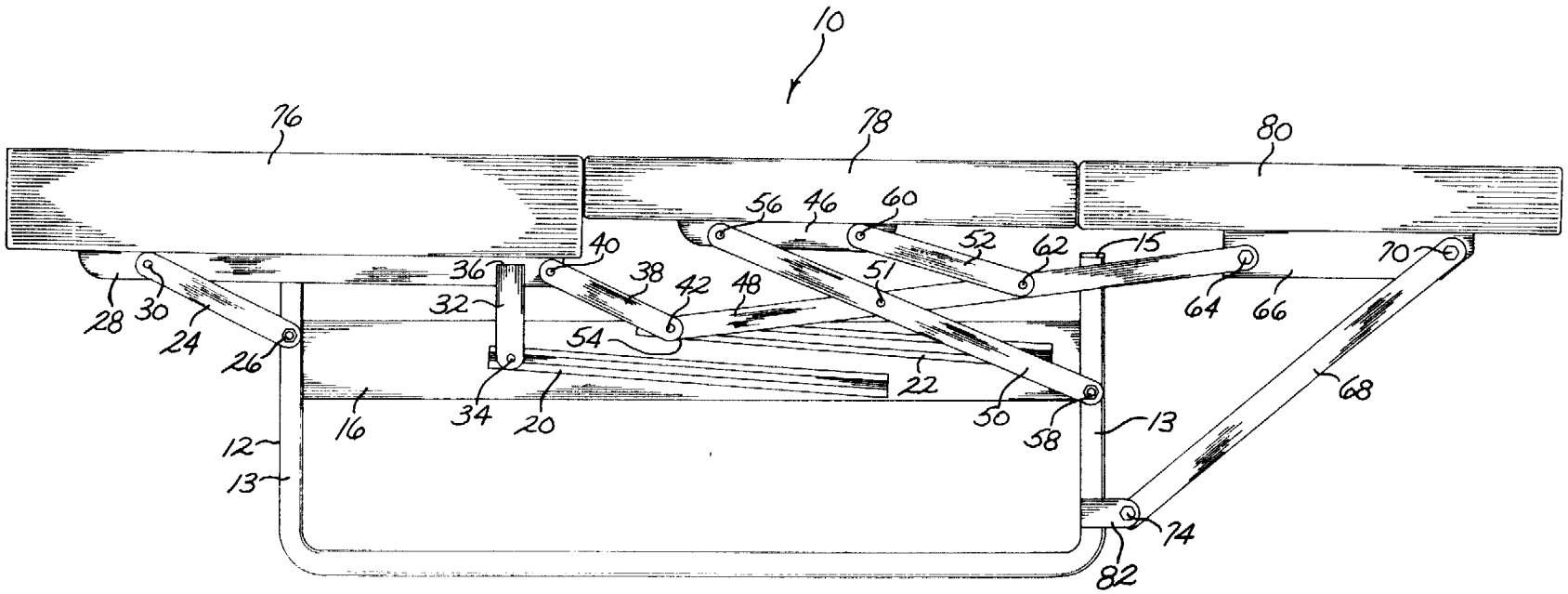
FIG. 5 is a side elevational view of the assembly in its bed position.

The seat-bed assembly 10 shown in the drawings is adapted for use in vans, campers and other recreational vehicles. Assembly 10 includes a support frame 11 formed of spaced U-shaped end members 12. End members 12 are connected by longitudinal cross members 15 which extend the length of the assembly. Each end member 12 includes vertical legs 13 between which a support 16 extends. Guide channels 20 and 22 as shown in FIGS. 3–5 are carried upon each support 16. The connecting linkage extending from each end member 16 is the same and thus only one complete end member is shown and will be described. It is understood that the other end member 16 and connecting linkage specifically described works and is constructed in similar fashion.

A link 24 is pivotally connected at 26 to front leg 13 of U-shaped member 12 and is connected to the front of a seat support 28 at pivot 30. A bench type seat cushion 76 is attached to support 28. A link 32 is slidably retained at its lower end 34 for movement along guide channel 20 by a roller (not shown) located within the guide channel and is fixedly connected at its upper end 36 to the rear of seat support 28. A link 38 is pivotally connected at one end 40 to seat support 28 adjacent link 32 and is slidably retained for movement along guide channel 22 at its other end 42 by a roller (not shown) located within the guide channel.

A lazy tong-like linkage controls movement of a back support 46 and includes links 48,50 and 52. A back cushion 78 is attached to support 46. One end 54 of link 48 is pivotally connected to end 42 of link 38 and is slidably retained for movement along guide channel 22. Links 50 and 52 are pivotally connected to intermediate parts of link 48 as shown in FIGS. 3–5. Link 50 is pivotally connected at one end 56 to back support 46 at its center 51 to link 42 and is pivotally connected at its other end 58 to rear leg 13 of U-shaped member 12. Link 52 is pivotally connected at its one end 60 to back support 46 at a location rearwardly of link 50 and to link 48 at its other end 62.

Link 48 extends beyond link 52 and is pivotally connected at its end 64 to extender support 66. A bed extender cushion 80 is attached to support 66. A link 68 is pivotally connected at one end 70 to extender support 66 at a location outwardly of link 48 and is pivotally connected at its other end 74 to a bracket 82 attached to leg 13 of U-shaped member 12 at a location below link 50.

Seat-bed assembly 10 is operated as follows: With all the links in the position of FIG. 5, assembly 10 functions as a conventional seat. By grasping seat cushion 76 and sliding it outwardly as seen in FIG. 4, cushions 76 and 78 assume a horizontal aligned orientation, as explained in U.S. Pat. No. 4,321,716, with seat support 28 resting upon end member 12. Simultaneously, extender cushion 80 swings into an aligned horizontal position as seen in FIG. 3. In this position, cushions 76, 78 and 80 form a flat, full-sized bed. To restore assembly 10 to its seat position, seat cushion 76 is pivoted inwardly to bring back cushion 78 upwardly and to shift extender cushion into its upper generally vertical position. It should be noted that bed assembly 10 may be folded or extended either by hand or by mechanized means such as a motor, not shown.

It is to be understood that the scope of the invention is not to be limited to the above description, but may be modified within the scope of the appended claims.

I claim:

1. A convertibe seat-bed assembly comprising a base frame, a seat support for supporting a seat cushion, a back support for supporting a back cushion, and an extender support for supporting a bed cushion, first linkage means connected between said frame and seat and back supports for supporting the seat and back supports for movement between a seat position wherein the seat support is generally horizontal and the back support is generally vertical and a bed position wherein the seat and back supports are horizontal, said first linkage means connected to said extender support, and second linkage means connected between said frame and said extender support for supporting the extender support in conjunction with said first linkage means for movement between a generally vertical position when said back support is in its seat position and a horizontal position aligned with said seat and back supports when the back support is in its bed position.

2. The seat-bed assembly of claim 1 wherein said first linkage means includes four links, a first of said links pivotally connected to said frame and said seat support, a second of said links connected to said seat support and slidable along a guide member carried by said frame, a third of said links connected between said back support and a fourth of said links, said fourth link associated with said second link for movement with the second link, said fourth link connected to said extender support, and said second linkage means including a link connected between said extender support and said frame.

3. The seat-bed assembly of claim 2 wherein said firt linkage means includes a fifth link connected between said seat support and slidable along a second guide member carried by said frame.

4. The seat-bed assembly of claim 2 wherein said first linkage means includes a sixth link connected between said back support and said frame.

* * * * *